US008092654B2

(12) United States Patent
Yazaki et al.

(10) Patent No.: US 8,092,654 B2
(45) Date of Patent: Jan. 10, 2012

(54) PROCESS BELT FOR PAPERMAKING AND METHOD FOR MAKING THE SAME

(75) Inventors: Takao Yazaki, Tokyo (JP); Atsushi Ishino, Tokyo (JP); Kenji Inoue, Tokyo (JP); Ai Tamura, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 12/954,792

(22) Filed: Nov. 26, 2010

(65) Prior Publication Data

US 2011/0127000 A1 Jun. 2, 2011

(30) Foreign Application Priority Data

Nov. 27, 2009 (JP) ..... 2009-269408

(51) Int. Cl.
*D21F 3/02* (2006.01)

(52) U.S. Cl. ..... 162/358.4; 162/901

(58) Field of Classification Search ..... 162/306, 162/358.3, 358.4, 901; 442/104, 105, 148; 528/59, 64; 524/492, 493
See application file for complete search history.

(56) References Cited

U.S. PATENT DOCUMENTS

| | | | | |
|---|---|---|---|---|
| 4,923,520 | A * | 5/1990 | Anzai et al. | 106/490 |
| 5,298,124 | A * | 3/1994 | Eklund et al. | 162/306 |
| 6,905,734 | B2 * | 6/2005 | Withers et al. | 427/425 |
| 2004/0029474 | A1 | 2/2004 | Watanabe et al. | |
| 2005/0208288 | A1 | 9/2005 | Li et al. | |
| 2006/0191658 | A1 | 8/2006 | Watanabe et al. | |
| 2009/0014143 | A1 | 1/2009 | Kobayashi et al. | |
| 2010/0032121 | A1 | 2/2010 | Nakagawa et al. | |
| 2010/0147480 | A1 | 6/2010 | Yazaki et al. | |
| 2010/0186920 | A1 | 7/2010 | Yazaki et al. | |
| 2010/0314067 | A1 | 12/2010 | Yazaki et al. | |
| 2011/0017419 | A1 | 1/2011 | Yazaki et al. | |

FOREIGN PATENT DOCUMENTS

| | | | |
|---|---|---|---|
| EP | 0 576 115 | A1 | 12/1993 |
| EP | 1 338 696 | A1 | 8/2003 |
| GB | 2284772 | * | 6/1995 |
| JP | 2001-263427 | | 9/2001 |
| JP | 3264461 | | 12/2001 |
| JP | 2002-146694 | | 5/2002 |
| JP | 2007-9389 | | 1/2007 |
| JP | 2007-530800 | | 11/2007 |
| JP | 2008-111220 | | 5/2008 |
| JP | 2008-156779 | | 7/2008 |
| JP | 2008-285784 | | 11/2008 |
| JP | 2009-173839 | | 8/2009 |
| JP | 4616403 | | 10/2010 |
| WO | WO 2005/090429 | A1 | 9/2005 |

OTHER PUBLICATIONS

Decision to Grant a Patent, Dispatch No. 682318, Dispatch Date Sep. 28, 2010, reference No. IY-07.
U.S. Appl. No. 13/030,851, filed Feb. 18, 2011, Yazaki et al.
Extended Search Report issued Feb. 28, 2011 in Europe Application No. 10014967.3.

* cited by examiner

*Primary Examiner* — Eric Hug
(74) *Attorney, Agent, or Firm* — Oblon, Spivak, McClelland, Maier & Neustadt, L.L.P.

(57) ABSTRACT

A process belt for papermaking with a long operational life comprises an integrated structure of a reinforcing fibrous base material 6 and a polyurethane layer, the reinforcing fibrous base material being embedded in the polyurethane, wherein an inorganic filler selected from calcined kaolin clay, fused silica and zeolite is homogeneously dispersed in the polyurethane.

12 Claims, 2 Drawing Sheets

(a)

PROCESS BELT FOR PAPERMAKING AND METHOD FOR MAKING THE SAME

TECHNICAL FIELD

The present invention relates to a polyurethane process belt for papermaking used in a papermaking machine as shoe press belt, transfer belt, calender belt and the like, having high hardness and high extensibility and flexural properties. In a papermaking machine, a shoe press belt is for example compressed together with a papermaking press felt (also called press fabric), on which a wet paper web has been placed, by a press roll and a shoe for squeezing moisture comprised in the wet paper web. The present invention also relates to a method for making the process belt.

BACKGROUND ART

In the papermaking process, a papermaking machine is conventionally equipped with a wire part, a press part and a dryer part for squeezing water from a wet paper web. The wire part, press part and dryer part are arranged in this order in the transfer direction of the wet paper web. The wet paper web is squeezed while being transferred by passing from one papermaking equipment to the next provided in the wire part, the press part and the dryer part, and is finally dried in the dryer part.

In these parts, papermaking equipment is used which corresponds to the functions of dewatering the wet paper web (wire part), squeezing water from the wet paper web (press part) and drying the wet paper web (dryer part). Moreover, the press part is generally equipped with one or more press devices arranged in series next to each other in the direction in which the wet paper web is transferred.

In each press device, an endless felt (closed type) or an open-ended felt that has been formed into an endless felt by connecting it in the papermaking machine is provided. Each press device also comprises a pair of rolls, which face each other (namely, a roll press), or a roll and a shoe press; the wet paper web is placed on the felt, and, while it is moving together with the felt in the wet paper web transfer direction, moisture is squeezed from the wet paper web by pressing the wet paper web together with the felt and the shoe press belt in the roll press or in the shoe press; the moisture pressed from the wet paper web is continuously absorbed by the felt or passes through the felt to be discharged to the outside of the felt.

Hereinafter, one example of the above-mentioned press device part will be described with reference to FIG. 5. By using a shoe press mechanism in which a shoe press belt 2 in loop shape is interposed between a press roll 1 and a shoe 5, dewatering is performed by passing a transfer felt 3 and a wet paper web 4 in the press portion formed by the press roll 1 and the shoe 5.

As shown in FIG. 2, the shoe press belt 2 is configured by providing an outer circumferential polyurethane layer 21 and an inner circumferential polyurethane layer 22 on both sides of a fibrous base material 6 which is sealed (embedded) in the polyurethane layers; wherein moreover a plurality of concave grooves 24 is formed in the surface of the press roll-side outer circumferential polyurethane layer 21, and the water wrung from the wet paper web 4 during the pressing described above is retained in the concave grooves 24, so that the detained water is further removed to the outside of the pressing portion by the rotation of the belt. For this reason, convex parts 25, provided on the press roll-side outer circumferential polyurethane layer 21, are required to have improved wear resistance, crack resistance, flexural fatigue resistance and other mechanical characteristics vis-à-vis the pressing force in the perpendicular direction applied by the press roll 1 as well as in relation to the wear and flexural fatigue of the shoe press belt occurring in the shoe press region.

For these reasons, polyurethane having good crack resistance is widely used as resin material for forming the outer circumferential polyurethane layer 21 of the shoe press belt 2.

JP, A, 2002-146694 (Patent Document 1), for example, proposes a shoe press belt made from an integrated structure of a reinforcing fibrous base material and polyurethane, the polyurethane comprising an outer circumferential layer and an inner circumferential layer, the reinforcing fibrous base material being embedded in the polyurethane, wherein a polyurethane of the outer circumferential layer is a polyurethane with a "JIS A hardness" of 89 to 94 made by curing mixed composition of

- a urethane prepolymer (manufactured under the trade name of Hiprene L by Mitsui Chemicals, Inc.) having a terminal isocyanate group and obtained by reacting tolylene-2,6-diisocyanate (TDI) with polytetramethylene glycol (PTMG), and
- a curing agent (also called chain extension agent) containing dimethylthiotoluene diamine,
- in which the urethane prepolymer and the curing agent are mixed such that the equivalent ratio (H/NCO) of the active hydrogen group (—H) of the curing agent and the isocyanate group (—NCO) of the urethane prepolymer is in the range of $1<H/NCO<1.15$, and a polyurethane of the inner circumferential layer is a polyurethane made by curing a mixed composition of

- a urethane prepolymer having a terminal isocyanate group and obtained by reacting 4,4'-methylenebis(phenylisocyanate) (MDI) with polytetramethylene glycol (PTMG), and
- a curing agent mixture of 65 parts of dimethylthiotoluene diamine and 35 parts of polytetramethylene glycol (PTMG),
- in which the urethane prepolymer and the curing agent are mixed such that the equivalent ratio (H/NCO) of the active hydrogen group (H) of the curing agent and the isocyanate group (NCO) of the urethane prepolymer is in the range of $0.85 \leqq H/NCO<1$.

JP, A, 2002-146694 (Patent Document 1) further proposes a papermaking process belt made from an integrated structure of a reinforcing base material and thermosetting polyurethane, the reinforcing base material being embedded in the polyurethane, the outer circumferential surface and the inner circumferential surface being made from the polyurethane, wherein a polyurethane, which forms the outer circumferential surface, is made from polyurethane of a composition comprising a urethane prepolymer having a terminal isocyanate group and a curing agent containing dimethylthiotoluene diamine.

JP, A, 2008-285784 (Patent Document 2), moreover, proposes a shoe press belt, shown in FIG. 1, comprising a reinforcing fibrous base material 6, embedded in polyurethane, an outer circumferential layer 2*a* and an inner circumferential layer 2*b*, each made of polyurethane, wherein the outer circumferential layer is made from a polyurethane comprising a polyurethane layer comprising an urethane prepolymer (A) produced by reacting an isocyanate compound selected from p-phenylene-diisocyanate and 4,4'-methylenebis(phenylisocyanate) with a polytetramethylene glycol (PTMG) and having a terminal isocyanate group, and a curing agent mixture (B) comprising 1,4-butanediol and an aromatic polyamine having an active hydrogen group (H).

Compared to the shoe press belt according to Patent Document 1, the shoe press belt according to Patent Document 2 uses a straight chain polyol compound as polyol component and an isocyanate compound selected from p-phenylene-diisocyanate and 4,4'-methylenebis(phenylisocyanate) of which the hardness, flexural resistance and curing speed as polyisocyanate of the polyurethane material are difficult to adjust; therefore, it has the excellent properties such as resistance against flexural fatigue, resistance to crack propagation, resistance to groove closure, hardness, elongation properties and toughness of the wear characteristics.

JP, T, 2007-530800 (Patent Document 3), moreover, proposes a papermaking process belt having a polyurethane layer comprising a coating which has polyurethane, as its base, using TDI and MDI as isocyanate compounds and including an amount from about 0.01 to about 10% by weight, preferably 1 to 5% by weight, of nanoparticles ranging in lengths from about 100 nm to about 500 nm but not exceeding an average size distribution of 100 nm. Patent Document 3 mentions that this papermaking process belt improves at least one of the following characteristics: resistance to flex fatigue, resistance to crack propagation, resistance to groove closure, hardness, elongation characteristics and wear characteristics.

The specification of Japanese Patent No. 3264461 (Patent Document 4) is related to a transfer belt (conveyor belt) and discloses a transfer belt used in a papermaking or paperboard-making machine and the like for carrying a web from a first transfer point, where the transfer belt is subjected to compression, in a closed draw to a second transfer point. The transfer belt comprises a reinforcing base fabric and an aliphatic polyurethane polymer coating on the paper side (outer layer) of the reinforcing base fabric, wherein the reinforcing base fabric has a back side and the above-mentioned paper side, the polymer film is formed by coating and drying an aliphatic polyurethane aqueous dispersion liquid comprising 23.6% by weight of kaolin clay and 67.5% by weight of aliphatic polyurethane (solid volume) on the reinforcing base fabric surface, and has a hardness ranging from Shore A 50 to Shore A 90, the polymer film comprises a web-contacting surface with a pressure-responsive recoverable degree of roughness, the roughness before the polymer film is compressed is in the range from Rz=2 microns to 80 microns, when the transfer belt is in the press nip, this roughness is in the range from Rz=0 micron to 20 microns, and after exiting the press nip, it is capable of returning to the roughness it had before the compression.

Patent Document 3 lists clay, carbon black, silica, silicon carbide, or metallic oxides such as alumina as examples of nanoparticles. As examples of metallic oxides are listed aluminum oxide, titanium oxide, iron oxide, zinc oxide, indium oxide, tin oxide, antimony oxide, cerium oxide, yttrium oxide, zirconium oxide, copper oxide, nickel oxide and/or tantalum oxide and combinations thereof. For example, in one embodiment, up to 1% by weight of uncoated alumina, alumina coated with epoxysilane or octylsilane was added. It is further mentioned that clays may include montmorillonite such as Cloisite (registered trade name) 30B, saponite, hectorite, mica, vermiculite, bentonite, nontronite, volkonskoite, manadiite and henyaite and combinations thereof.

The papermaking process belt according to Patent Document 3 has a higher surface hardness than the transfer belt disclosed in Patent Document 4; moreover the figures for resistance to flex fatigue and resistance to crack propagation disclosed in its specification are about 4 to 5 times better than those for the papermaking process belt according to Patent Document 1; however, resistance to flex fatigue and resistance to crack propagation of the papermaking process belt according to Patent Document 3 are inferior to the corresponding figures for the shoe press belt according to Patent Document 2.

The shoe press belt according to Patent Document 2 uses an isocyanate compound selected from p-phenylene-diisocyanate and 4,4'-methylenebis(phenylisocyanate); therefore, there is the disadvantage that it is difficult to control the temperature when the polyisocyanate compound and the curing agent are heated.

The process belt of Patent Document 4 uses an aliphatic polyurethane aqueous dispersion liquid comprising 23.6% by weight of kaolin clay and 67.5% by weight of aliphatic polyurethane (solid volume) as coating agent; therefore, there is an increase in the "JIS A hardness" of the belt due to the kaolin clay and an improvement of the extensibility of the belt due to the aliphatic polyurethane; however, the improvement of the durability is still insufficient.

PRIOR ART DOCUMENTS

Patent Documents

[Patent Document 1] JP, A, 2002-146694
[Patent Document 2] JP, A, 2008-285784
[Patent Document 3] JP, T, 2007-530800
[Patent Document 4] JP, B, 3264461

SUMMARY OF THE INVENTION

Technical Problem

The means for increasing the effect of suppressing the fatigue crack growth rate of a papermaking shoe press belt by blending nanoparticles according to Patent Document 3 has the advantage that it can be used without specifying the type of polyisocyanate compound of the polyurethane raw material. Nevertheless, there is the disadvantage that the dispersion of the nanoparticles in the urethane prepolymer and, when the curing agent is mixed, the further uniform dispersion of the nanoparticles in the curable urethane composition causes the nanoparticles to absorb the moisture in the air and react with the polyisocyanate compound and induces secondary aggregation of the nanoparticles; thus it is difficult to use more than 10% by weight of nanoparticles. Mixtures with 0.1 to 10% by weight of nanoparticles may also be employed for shoe press belts; however, for process belts which require hydrophilic properties a higher blending ratio of the nanoparticles is preferred.

During the evaluation of the effect of suppressing the fatigue crack growth rate in papermaking process belts produced from polyurethane using an inorganic filler of an average particle size of 1 to 20 μm which is homogeneously dispersed in a curable urethane composition, the present inventors discovered that an inorganic filler comprising 50% by weight or more of a silicon oxide component from calcined kaolin clay, fused silica, zeolite of an average particle size of 1 to 20 μm, or from particles thereof that have been surface treated by an organic silane coupling agent can further improve the suppression of the fatigue crack growth rate by a factor of 2 to 10.

Solution to Problem

The invention of claim 1 proposes a papermaking process belt comprising an integrated structure of a reinforcing fibrous base material and a polyurethane layer, the reinforcing fibrous base material being embedded in the polyurethane; wherein one part of the polyurethane or all of the polyurethane is formed by heat curing of a curable urethane composition comprising a urethane prepolymer having a terminal isocyanate group and which is obtained by reacting an aromatic isocyanate compound and polyol, a curing agent having an active hydrogen group, and 0.3 to 30% by weight of an inorganic filler of which the main component is a silicon oxide component selected from calcined kaolin clay, fused silica and zeolite of an average particle size of 1 to 20 μm.

The invention of claim 2 proposes a papermaking process belt according to claim 1, wherein, in the inorganic filler, the particle surfaces of the calcined kaolin clay or the fused silica are treated with 0.2 to 3% by weight (as a percentage of the weight of the inorganic filler that is surface-treated by the organic silane coupling agent) of an organic silane coupling agent.

The invention of claim 3 proposes a papermaking process belt according to claim 1, wherein the "JIS A hardness" of the polyurethane outer layer side of the papermaking process belt that is in contact with the wet paper web is 91 to 100.

The invention of claim 4 proposes a method for making a papermaking process belt comprising an integrated structure of a reinforcing fibrous base material and a polyurethane layer, the reinforcing fibrous base material being embedded in the polyurethane; wherein are comprised a process for obtaining a curable urethane composition by mixing a urethane prepolymer, a curing agent having an active hydrogen group and an inorganic filler, and a process for forming a polyurethane layer by heat-curing a curable urethane composition, wherein one part or all the polyurethane is made from the curable urethane composition and a reinforcing fibrous base material is embedded therein, and wherein the inorganic filler comprises, as main component, a silicon oxide component selected from calcined kaolin clay, fused silica and zeolite of an average particle size of 1 to 20 μm, and wherein the inorganic filler is 0.3 to 30% by weight of the curable urethane composition, and the urethane prepolymer having a terminal isocyanate group is made by reacting an aromatic isocyanate compound and a polyol.

Advantageous Effects of the Invention

The papermaking process belt of the present invention uses an inorganic filler of which the main component are silicon oxide particles from calcined kaolin clay, fused silica and zeolite which, with an average particle size of 1 to 20 μm, have a large particle size; therefore, the inorganic filler can be easily blended with the curable urethane composition, and the bonding of the inorganic filler with the aromatic-type polyurethane to be formed is also strong. Moreover, with a blending ratio of 0.3 to 30% by weight, the inorganic filler can also be blended at an increased ratio, and it is possible to provide a polyurethane process belt with high hardness and a fatigue crack growth rate suppressing effect 5 to 20 times higher than that of the commercially available polyurethane shoe press belts, transfer belts, calender belts and other papermaking process belts.

DESCRIPTION OF EMBODIMENTS

Figure 1:
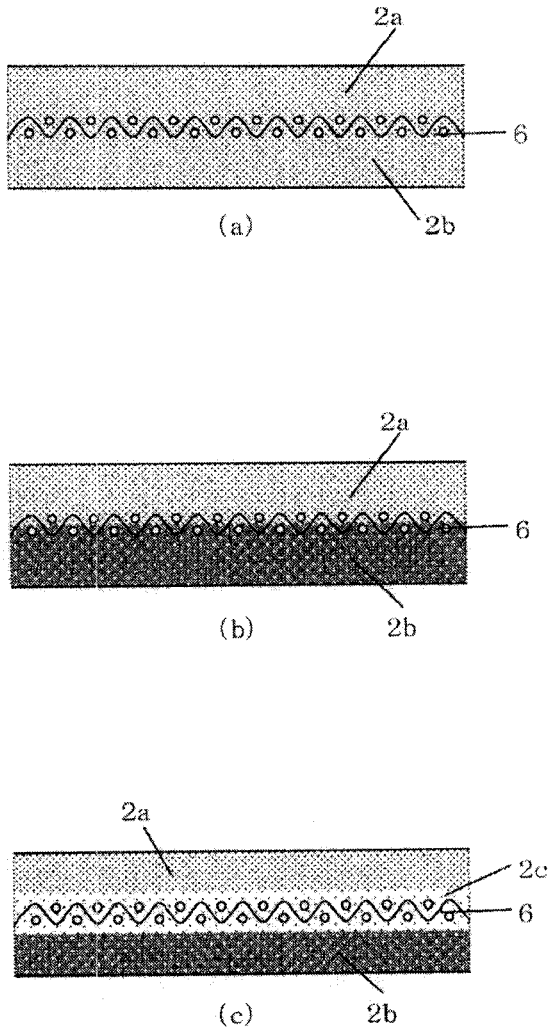
FIG. 1 is a cross-sectional view of a shoe press belt according to the present invention.

Hereinafter, the present invention will be described in still greater detail with reference to the drawings. FIG. 1 is a cross-sectional view showing one example of a shoe press belt according to the present invention, wherein a reinforcing fibrous base material and a polyurethane layer are made into an integrated structure and the reinforcing fibrous base material is embedded in the polyurethane layer. FIG. 1(*a*) shows a single polyurethane layer; FIG. 1(*b*) shows polyurethane of two layers: an outer circumferential layer (2*a*) and an inner circumferential layer (2*b*); FIG. 1(*c*) shows polyurethane of three layers: an outer circumferential layer (2*a*), an intermediate layer (2*c*) and an inner circumferential layer (2*b*).

In any one of the above-mentioned shoe press belt structures, one part of the polyurethane or all of the polyurethane in a polyurethane process belt is formed by curing a curable urethane composition comprising a urethane prepolymer having a terminal isocyanate group, a curing agent having an active hydrogen group, and an inorganic filler of which the main component is a silicon oxide component selected from calcined kaolin clay, fused silica, zeolite of an average particle size of 1 to 20 μm, preferably 1 to 10 μm, and surface treated inorganic fillers of the calcined kaolin clay, fused silica of which the particle surface has been treated with an organic silane coupling agent having an active hydrogen group (II). The above-mentioned curable urethane composition comprises the inorganic filler in an amount of 0.3 to 30% by weight, preferably 1.0 to 20% by weight in the case of a shoe press belt, 12 to 28% by weight in the case of transfer belt in which hydrophilic properties are desirable, and 3 to 20% by weight in the case of a calender belt.

The above-mentioned urethane prepolymer (A) has an isocyanate group (—NCO) at its terminal and is obtained by reacting an aromatic polyisocyanate compound (a) and a polyol (b). The terminal isocyanate group of the urethane prepolymer (A) may be masked with a blocking agent of phenol, oxime, alcohol, organic aliphatic amine, organic carboxylic acid and the like.

Examples of the aromatic polyisocyanate compound (a) include one or more polyisocyanates selected from 2,4-tolylene-diisocyanate, 2,6-tolylene-diisocyanate, 1,5-napthalene-diisocyanate, p-phenylene-diisocyanate, 4,4'-methylenebis(phenylisocyanate) and metaxylene diisocyanate. Particularly preferred are TDI, MDI because they require little heat curing energy when the polyurethane is produced.

Examples of the polyol (b) include one or more polyols selected from polyether polyols such as polytetramethylene glycol, polyethylene glycol, polypropylene glycol and the like, and polyester polyols such as polycaprolactone ester, polycarbonate, polyethylene adipate, polybutylene adipate, polyhexane adipate and the like. Particularly preferred are polyether polyols with a molecular weight of 230 to 3000 such as polytetramethylene glycol, polyethylene glycol, polypropylene glycol and the like.

The isocyanate group (—NCO) of the aromatic polyisocyanate compound (a) is reacted such that the equivalent ratio in relation to the hydroxyl group (—OH) of the polyol (b) is L or more and isocyanate groups remain at the terminal of the urethane prepolymer produced.

Examples of the curing agent (B) having an active hydrogen group (—H) include one or more curing agents selected from aliphatic polyols such as 1,4-butandiol, glycerin, pentaerythritol and the like, aromatic polyamines with a molecular weight of 108 to 380, preferably 198 to 342, selected from a mixture of 3,5-diethyltoluene-2,4-diamine and 3,5-diethyltoluene-2,6-diamine (trade name Ethacure 100), 4,4'-bis(2-chloroaniline), a mixture of 3,5-dimethylthio-2,4-toluenediamine and 3,5-dimethylthio-2,6-toluenediamine (trade name Ethacure 300), 4,4'-bis(sec-butylamino)-diphenylmethane, N,N'-dialkyldiaminodiphenylmethane, 4,4'-methylenedianiline (MDA), 4,4'-methylene-bis(2,3-dichloroaniline) (TCDAM), 4,4'-methylene-bis(2-chloroaniline) (MOCA), 4,4'-methylene-bis(2-ethyl-6-methylaniline) (trade name CUREHARD MED), trimethylene-bis(4-aminobenzoate) (trade name CUA-4), and m-phenylenediamine (MPDA).

The isocyanate group (—NCO) of the urethane prepolymer (A) and the active hydrogen group (—H) of the curing agent (B) are used at such a proportion that the equivalent ratio (—H/—NCO) with the isocyanate group (—NCO) of the urethane prepolymer (A) is $0.88 \leqq N/NCO \leqq 1.12$, and preferably $0.95 \leqq N/NCO \leqq 1.0$. The polyurethane layer of the outer layer is formed by heat curing the curable urethane mixed composition of the urethane prepolymer and the curing agent and 0.3 to 30% by weight of the inorganic filler at 70 to 140° C. for 2 to 20 hours. A low H/NCO ratio is desirable for increasing the wear resistance of a polyurethane belt, whereas a high H/NCO ratio is desirable for increasing the crack prevention properties of a polyurethane belt.

Examples of the inorganic filler (C) include inorganic fillers of which the main component is a silicon oxide component selected from calcined kaolin clay, fused silica, zeolite of an average particle size of 1 to 20 μm, preferably 1 to 10 μm, and surface treated inorganic fillers of the calcined kaolin clay, fused silica of which the particle surface has been treated with an organic silane coupling agent. These inorganic fillers (C) are used with a moisture content of less than 1.0% by weight, and preferably 0.0001% by weight or less.

Examples of organic silane coupling agents preferably include organic silane coupling agents having an active hydrogen group (—H) such as amine group (—$NH_2$)-modified organosilane coupling agent, mercapto group (—SH)-modified organosilane coupling agent, carboxyl group (—COOH)-modified organosilane coupling agent and the like, and modified organosilane coupling agents having an alkoxy group (OR) and an active hydrogen group (—H). These coupling agents may be used on their own, or two or more may be used together. Moreover, organic silane coupling agents having an active hydrogen group (—H) also include alkoxy group-modified organic silane coupling agents and amide group-modified organic silane coupling agents which exhibit an active hydrogen group (—H) by dissolving due to heating and reacting with the moisture in the air.

Specific examples of modified-organosilane coupling agents include 3-octanoylthiopropyltriethoxysilane, γ-ureidepropyltriethoxysilane, β-(3,4-epoxycyclohexyl)ethyltrimethoxysilane and the like.

Specific examples of the amino group-modified organosilane coupling agents include N-β(aminoethyl)γ-aminopropyltrimethoxysilane, N-β(aminoethyl)γ-aminopropylmethyldimethoxysilane, γ-aminopropyltriethoxysilane, N-phenyl-γ-aminopropyltrimethoxysilane, N-2-(aminoethyl)3-aminopropylmethyldimethoxysilane, N-2-(aminoethyl)3-aminopropyltrimethoxysilane, N2-(aminoethyl)-3-aminopropyltriethoxysilane, 3-aminopropyltrimethoxysilane, 3-aminopropyltriethoxysilane, 3-triethoxysilyl-N-(1,3-dimethyl-butylidene) propylamine, N-phenyl-3-aminopropyltrimethoxysilane, γ-chloropropyltrimethoxysilane and the like.

Specific examples of the epoxy group-modified organosilane coupling agents include γ-glycidoxypropyltrimethoxysilane, γ-glycidoxypropyltriethoxysilane, γ-glycidoxypropylmethyldiethoxysilane, γ-glycidoxypropyltrimethyldiethoxysilane, 2-(3,4-epoxycyclohexyl)ethyltrimethoxysilane and the like.

Specific examples of mercapto group (—SH)-modified organosilane coupling agents include γ-mercaptopropyltrimethoxysilane, 3-octanoylthiopropyltriethoxysilane, 3-mercaptopropylmethyldimethoxysilane, 3-mercaptopropyltrimethoxysilane, bis(triethoxysilylpropyl)tetrasulfide and the like.

Specific examples of carboxyl group (—COOH)-modified organosilane coupling agents include 3-methacryloxypropylmethyldiethoxysilane, 3-methacryloxypropyltriethoxysilane, 3-acryloxypropyltrimethoxysilane and the like.

Among these, 3-aminopropyltriethoxysilane, 3-(2-aminoethyl)aminopropyltrimethoxysilane are preferred because of their excellent affinity with fused silica, calcined kaolin clay and polyurethane. In other words, the organic silane coupling agent has good affinity with the inorganic filler having $SiO_2$ as main component, and the active hydrogen group (—H) of the organic silane coupling agent reacts with the isocyanate group when the curable urethane composition is cured; therefore, the bond between the polyurethane produced and the inorganic filler is stronger.

The amount used of the organic silane coupling agent having an active hydrogen group is 0.2 to 3% by weight, preferably 0.5 to 1.5% by weight, of the inorganic filler.

As a calcined kaolin clay (C), for example, 3-aminopropyltriethoxysilane-modified calcined kaolin clay is available under the trade name of Translink 445 (average particle size: 1.4 μm, specific surface area: 10.4 $m^2/g$) from the German BASF company, calcined kaolin clay is available under the trade names of Satintone W (average particle size: 1.4 μm, specific surface area: 10.4 $m^2/g$) from BASF, under the trade names of Polestar 200R from Imerys Mineral Ltd. and under the trade names of Calconed China Clay from JETRO. Moreover, fused silica (C) is available under the trade names of Fuselex X (average particle size: 2.5 μm, specific surface area 12.8 $m^2/g$) and Fuselex RD-8 (average particle size: 15.1 μm, specific surface area: 2.2 $m^2/g$), both from Tatsumori Co., Ltd. The 3-(2-aminoethyl)aminopropyltrimethoxysilane used for producing the 3-(2-aminoethyl)aminopropyltrimethoxysilane-modified calcined kaolin (C) and fused silica (C) is commercially available under the trade names of KBM-603from Shinetsu Chemical Industry, Z-6020 and Z-6094 from Dow Corning Toray Co., Ltd. and A-1120 and A-1122 from Momentive. Moreover, the 3-aminopropyltriethoxysilane used for producing the 3-aminopropyltriethoxysilane-modified calcined kaolin (C) and fused silica (C) is commercially available under the trade names of KBE-903 from Shinetsu Chemical Industry, Z-6011 from Dow Corning Toray Co., Ltd. and A-1100 from Momentive. The zeolite used has a water content of less than 1% by weight. Natural zeolite (silicate-water-containing substance) is a water-containing substance, even commercially available zeolite and synthetic zeolite contain water; therefore, zeolite with a water content exceeding 1.0% by weight is dried by heating so as to volatilize the water content.

The amount of inorganic filler (C) comprising 50% by weight or more of the $SiO_2$ contained in the polyurethane is in the range from 0.3 to 30% by weight. With less than 0.3% by weight, an increase in hardness and the fatigue crack growth rate suppressing effect cannot be expected. With more than 30% by weight, a further increase in hardness and the fatigue crack growth rate suppressing effect cannot be expected, it is difficult to uniformly mix the urethane prepolymer (A), the curing agent (B) and the inorganic filler (C), and the layering of the curable urethane composition for the outer layer becomes cumbersome.

The polyurethane raw material and the curing agent used for forming the inner layer and the intermediate layer are also selected from the polyisocyanate compound (a), polyol (b) and curing agent (B). The material composition of polyurethane of the outer layer, the polyurethane of the intermediate layer and the polyurethane of the inner layer may be identical or different. Moreover, the polyurethane of the intermediate layer and the polyurethane of the inner layer may or may not comprise 0.3 to 30% by weight of the inorganic filler.

Figure 2:
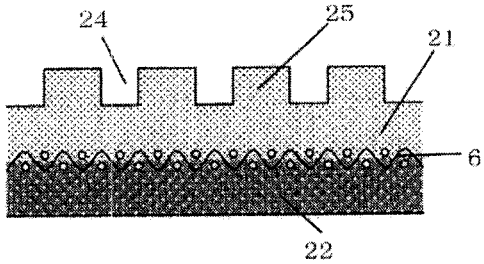
FIG. 2 is a cross-sectional view of a shoe press belt according to the present invention.

The process belt shown in FIG. 2 is a shoe press belt with a two-layered structure of an outer layer 21 comprising an inorganic filler (C) with 50% by weight or more of the $SiO_2$ and having, in its surface, concave grooves 24 for improving the water squeezing capability and an inner layer 22; 6 and 25 indicate reinforcing fibrous base material and convex parts respectively.

As reinforcing fibrous base material 6, not only the woven fabrics mentioned in Patent Documents 1 to 4 but also the reinforcing base materials mentioned in other documents can be used. For example, a grid-like web can be made from CMD (Cross Machine Direction) yarns comprising multifilament twisted yarns of 5,000 dtex made from polyethylene terephthalate (PET) fibers and MD (Machine Direction) yarns comprising multifilament yarns of 550 dtex; wherein the MD yarns are sandwiched by the CMD yarns and the crossings of the MD yarns and the CMD yarns are joined by a polyurethane adhesive. As fiber material, aramid fibers, Nylon 6,6, Nylon 6,10, Nylon 6 and other polyamide fibers can also be used instead of polyethylene terephthalate. Moreover, fibers of different materials can also be used for the MD yarns and the CMD yarns. It is also possible to use different fiber sizes such as 800 dtex and 7,000 dtex and the like for the CMD yarns and the MD yarns.

Even though the outer circumferential polyurethane layer is made from polyurethane of a "JIS A hardness" of 91 to 100, preferably 95 to 98, it has excellent wear resistance, crack resistance and flexural fatigue resistance.

In the manufacture of papermaking process belts, for example, a mixture of a urethane prepolymer and a curing agent for forming an inner circumferential polyurethane layer is coated onto the surface of a mandrel, which has been coated by a parting agent, while the mandrel is being rotated so as to form an inner circumferential polyurethane layer with a thickness of 0.8 to 3.5 mm on the mandrel surface. The layer of the coated mixture is then heated to a temperature between 70 and 140° C. and precured for 0.5 to 1 hour. Then, a woven reinforcing fibrous base material is placed on top of this inner circumferential polyurethane layer, and a mixture of a urethane prepolymer and a curing agent for forming the intermediate layer is coated to a thickness of 0.5 to 2 mm. The mixture for forming the intermediate layer impregnates the base fabric and bonds with the inner circumferential polyurethane layer. The layer of the coated mixture is precured at 50 to 120° C. for 0.5 to 1 hour to form the intermediate polyurethane layer reinforced by the fibrous base material. Then, while the mandrel is being rotated, a curable urethane composition comprising the urethane prepolymer (A), the curing agent (B) and the inorganic filler (C) for forming an outer circumferential polyurethane layer is coated onto the surface of the woven reinforcing fibrous base material, impregnating the same, to form the outer circumferential polyurethane layer with a thickness of 1.5 to 4 mm. The layer of the coated mixture is then cured by being heated to a temperature between 70 and 140° C. for 2 to 20 hours. Thereafter, grooves 24 shown in FIG. 2 are formed in the outer circumferential polyurethane layer if necessary. While the polyurethane layer is being heat cured, the grooves may be formed in the outer circumferential polyurethane layer by a heated embossing roll comprising ridges 25 on its surface, the height of which corresponds to the groove depth, which is being brought into contact with the outer circumferential polyurethane layer while it is being cured for forming the grooves. The mandrel as equipped with a heating device.

In another method for manufacturing a papermaking process belt, for example, a mixture of a urethane prepolymer and a curing agent for forming an inner circumferential polyurethane layer is coated onto a mandrel, the surface of which has been coated by a parting agent, so as to form a polyurethane layer with a thickness of 0.8 to 3 mm, which is then precured for 0.5 to 2 hours at a temperature between 70 and 140° C. Then, a reinforcing fibrous base material is placed on the outer surface of the cured polyurethane layer, and thereafter, a mixture of a urethane prepolymer and a curing agent for forming the intermediate layer is coated to a thickness of 0.5 to 2 mm. The mixture for forming the intermediate layer impregnates the base fabric and bonds with the inner circumferential layer. The layer of the coated mixture is precured at 50 to 120° C. for 0.5 to 1 hour to form the intermediate polyurethane layer reinforced by the fibrous base material. Next, a curable urethane composition comprising the urethane prepolymer (A), the curing agent (B) and the inorganic filler (C) for forming an outer circumferential surface is coated to form the outer circumferential polyurethane layer with a thickness of 2 to 4 mm, which is then post-cured at a temperature between 70 and 140° C. for 4 to 16 hours. Then grooves are cut with a cutting tool into the surface of the layered outer circumferential polyurethane layer in which the reinforcing fibrous base material is embedded, after which the outer circumferential polyurethane surface is polished by sandpaper or a polyurethane polishing cloth.

In another method for manufacturing a papermaking process belt comprising an intermediate layer, for example, a mixture of a urethane prepolymer and a curing agent for forming an inner circumferential layer is coated onto a mandrel, the surface of which has been coated by a parting agent, so as to form an inner circumferential layer with a thickness of 0.6 to 3 mm, which is then precured for 0.5 to 2 hours at a temperature between 50 and 140° C. Then, a previously manufactured intermediate polyurethane layer with a thickness of 1 to 2 mm in which a reinforcing fibrous base material is embedded is wound around the outer surface of the inner circumferential layer. Then, the intermediate layer is pressed by a nip roll which is heated to between 50 and 140° C. Next, a composition of the urethane prepolymer (A), the curing age at (B) and the inorganic filler (C) for producing the outer circumferential surface is further coated to form an outer circumferential polyurethane layer with a thickness of 2 to 4 mm, which is post-cured at 90 to 140° C. for 2 to 20 hours. Then, the outer circumferential surface of the layered polyurethane in which the reinforcing fibrous base material has been embedded is polished by sandpaper or a polyurethane polishing cloth; thereafter, grooves are cut in the surface of the outer circumferential surface by a cutting tool.

In another method for manufacturing a papermaking process belt, two rolls are used instead of the mandrel. An endless woven reinforcing fibrous base material is stretched between the two rolls. First, the surface of the fibrous reinforcing base material is coated with a blend of a urethane prepolymer and a curing agent, which impregnates the fibrous base material and is then precured at 50 to 120° C. for 0.5 to 3 hours. Thereafter, a mixture of a urethane prepolymer and a curing agent for forming the inner circumferential polyurethane layer of the process belt is coated so as to form the inner circumferential polyurethane layer with a thickness of 0.5 to 3 mm, which is then cured at 70 to 140° C. for 2 to 12 hours. The surface of the inner circumferential polyurethane layer is polished by sandpaper or a polishing cloth. Thus, the integral structure in which the inner circumferential polyurethane layer and the fibrous reinforcing base material are bonded is produced. Next, this partially finished process belt is reversed and stretched on the two rolls. Then, the surface of the stretched partially finished process belt is coated with a blend of a urethane prepolymer and a curing agent which impregnates the fibrous base material. The surface is further coated with a curable urethane composition comprising the urethane prepolymer (A), the curing agent (B) and the inorganic filler (C) to a thickness of 1.5 to 4 mm, which is cured at 70 to 140° C. for 2 to 20 hours. After completing the curing, the surface layer is polished to a prescribed thickness and grooves are formed by cutting the outer circumferential layer with a cutting tool.

EXAMPLES

Hereinafter, the production of polyurethane specimens for evaluating the physical properties of the polyurethane used for producing papermaking process belts will be described.

Reference Example 1

Used for Comparative Example 1

A curable urethane composition (with an H/NCO equivalent ratio of 0.95) was prepared by mixing a urethane prepolymer (NCO: 6.04%, preheating temperature: 30° C.), obtained by reacting tolylenediisocyanate (TDI) and polytetramethylene glycol (PTMG), and a curing agent mixture (Ethacure 300) of 3,5-dimethylthio-2,4-toluenediamine and 3,5-dimethylthio-2,6-toluenediamine. This curable urethane composition was poured into a preheated mold and heated to 100° C. After precuring at 100° C. for 30 minutes, post-curing was performed at 100° C. for 16 hours to obtain a cured polyurethane sheet (with a thickness of 3.4 mm, and having at its center a semicircular groove of 1.5 mm radius) of a "JIS A hardness" of 95.8. The specimens were made from this sheet.

Reference Examples 2 to 7

Used for Inventive Examples 1 to 6

A polyurethane sheet (with a thickness of 3.4 mm, and having at its center a semicircular groove of 1.5 mm radius) was obtained as in Reference Example 1 except that calcined kaolin clay (average particle size: 1.4 μm, specific surface area: 10.4 $m^2/g$) modified by 0.5% by weight of 3-aminopropyltriethoxysilane, which had been dried at 100° C. for 2 hours, was mixed beforehand with the prepolymer to obtain the ratios shown in Table 1 for 100 parts by weight of the urethane prepolymer and the curing agent after mixing (Reference Example 2: 1 part by weight, Reference Example 3: 5 parts by weight, Reference Example 4: 12 parts by weight, Reference Example 5: 20 parts by weight, Reference Example 6: 30 parts by weight, Reference Example 7: 40 parts by weight). The specimens were made from this sheet.

Reference Example 8

Used for Inventive Example 7

A polyurethane sheet (with a thickness of 3.4 mm, and having at its center a semicircular groove of 1.5 mm radius) was obtained as in Reference Example 5 except that a mixture of 3,5-diethyltoluene-2,4-diamine and 3,5-diethyltoluene-2,6-diamine (Ethacure 100) was used instead of the mixture of 3,5-dimethylthio-2,4-toluenediamine and 3,5-dimethylthio-2,6-toluenediamine (Ethacure 300) as curing agent for mixing with the prepolymer to obtain an equivalent ratio H/NCO of 1.00. The specimens were made from this sheet.

Reference Example 9

Used for Inventive Example 8

A polyurethane sheet (with a thickness of 3.4 mm, and having at its center a semicircular groove of 1.5 mm radius) was obtained as in Reference Example 8 except that a mixture of 50 molar % of 3,5-diethyltoluene-2,4-diamine and 3,5-diethyltoluene-2,6-diamine (Ethacure 100) and 50 molar % of 3,5-dimethylthio-2,4-toluenediamine and 3,5-dimethylthio-2,6-toluenediamine (Ethacure 300) was used as curing agent instead of the mixture of 3,5-diethyltoluene-2,4-diamine and 3,5-diethyltoluene-2,6-diamine (Ethacure 100). The specimens were made from this sheet.

Reference Example 10

Used for Inventive Example 9

A polyurethane sheet (with a thickness of 3.4 mm, and having at its center a semicircular groove of 1.5 mm radius) was obtained as in Reference Example 5 except that fused silica available under the trade name of Fuselex RD-8 (average particle size 15.1 μm, specific surface area 2.2 $m^2/g$) was used instead of the calcined kaolin clay modified by 0.5% by weight of 3-aminopropyltriethoxysilane. The specimens were made from this sheet.

Reference Example 11

Used for Inventive Example 10

A polyurethane sheet (with a thickness of 3.4 mm, and having at its center a semicircular groove of 1.5 mm radius) was obtained as in Reference Example 5 except that zeolite available under the trade name of SP 600 from Nitto Funka Kogyo K. K. (average particle size: 1.9 μm) which had been heated to 100° C. for reducing the moisture content to 1% or less was used instead of the calcined kaolin clay modified by 0.5% by weight of 3-aminopropyltriethoxysilane. The specimens were made from this sheet.

Reference Example 12

Used for Comparative Example 2

A polyurethane sheet (with a thickness of 3.4 mm, and having at its center a semicircular groove of 1.5 mm radius)

was obtained as in Reference Example 5 except that mica available under the trade name of SJ-005 from Yamaguchi Mica Co., Ltd. (average particle size: 5.1 μm) was used instead of the calcined kaolin clay modified by 0.5% by weight of 3-aminopropyltriethoxysilane. The specimens were made from this sheet.

Reference Example 13

Used for Comparative Example 3

A polyurethane sheet (with a thickness of 3.4 mm, and having at its center a semicircular groove of 1.5 mm radius) was obtained as in Reference Example 1 except that a urethane prepolymer with an NCO of 4.41% obtained by reacting tolylenediisocyanate (TDI) and polytetramethylene glycol (PTMG) was used instead of the methane prepolymer with an NCO of 6.04% obtained by reacting tolylenediisocyanate (TDI) and polytetramethylene glycol (PTMG). The specimens were made from this sheet.

Reference Example 14

Used for Inventive Example 11

A polyurethane sheet (with a thickness of 3.4 mm, and having at its center a semicircular groove of 1.5 mm radius) was obtained as in Reference Example 13 except that calcined kaolin clay available under the trade name of Satintone W (average particle size: 1.4 μm, specific surface area: 10.4 $m^2/g$), which had been dried at 100° C. for 2 hours, was mixed beforehand with the prepolymer to obtain a ratio of 10 weight parts for 100 weight parts of the mixture of the urethane prepolymer and the curing agent. The specimens were made from this sheet.

Reference Example 15

Used for Inventive Example 12

A polyurethane sheet (with a thickness of 3.4 mm, and having at its center a semicircular groove of 1.5 mm radius) was obtained as in Reference Example 14 except that calcined kaolin clay modified by 0.5% by weight of 3-aminopropyltriethoxysilane (average particle size: 1.4 μm, specific surface area: 10.4 $m^2/g$) was used instead of the calcined kaolin clay. The specimens were made from this sheet.

Reference Example 16

Used for Inventive Example 13

A polyurethane sheet (with a thickness of 3.4 mm, and having at its center a semicircular groove of 1.5 mm radius) was obtained as in Reference Example 14 except that fused silica available under the trade name of Fuselex X (average particle size: 2.5 μm, specific surface area: 12.8 $m^2/g$) was used instead of the calcined kaolin clay. The specimens were made from this sheet.

Reference Example 17

Used for Inventive Example 14

A polyurethane sheet (with a thickness of 3.4 mm, and having at its center a semicircular groove of 1.5 mm radius) was obtained as in Reference Example 14 except that fused silica modified by 1.0% by weight of 3-aminopropyltriethoxysilane (average particle size: 2.5 μm, specific surface area: 12.8 $m^2/g$) was used instead of the calcined kaolin clay. The specimens were made from this sheet.

Reference Example 18

Used for Inventive Example 15

A polyurethane sheet (with a thickness of 3.4 mm, and having at its center a semicircular groove of 1.5 mm radius) was obtained as in Reference Example 14 except that fused silica modified by 0.5% by weight of 3-(2-aminoethyl)aminopropyltrimethoxysilane (average particle size: 2.5 μm, specific surface area: 12.8 $m^2/g$) was used instead of the calcined kaolin clay. The specimens were made from this sheet.

Reference Example 19

Used for Comparative Example 4

A curable urethane composition (with an H/NCO equivalent ratio of 0.90) was prepared by mixing a urethane prepolymer (NCO: 9.04%, preheating temperature: 30° C.), obtained by reacting methylenebis(1,4-phenylene)diisocyanate (MDI) and polytetramethylene glycol (PTMG), and a curing agent mixed from 90 molar % of 1,4-butandiol and a 10 molar % of a mixture (Ethacure 300) of 3,5-dimethylthio-2,4-toluenediamine and 3,5-dimethylthio-2,6-toluenediamine. This curable urethane composition was poured into a mold which had been preheated at 115° C. After precuring at 115° C. for 3 hours, post-curing was performed at 115° C. for 14 hours to obtain a polyurethane sheet (with a thickness of 3.4 mm, and having at its center a semicircular groove of 1.5 mm radius). The specimens were made from this sheet.

Reference Example 20

Used for Inventive Example 16

A polyurethane sheet (with a thickness of 3.4 mm, and having at its center a semicircular groove of 1.5 mm radius) was obtained as in Reference Example 19 except that calcined kaolin clay (average particle size: 1.4 μm, specific surface area: 10.4 $m^2/g$) modified by 0.5% by weight of 3-aminopropyltriethoxysilane, which had been dried at 100° C. for 2 hours, was mixed beforehand with the prepolymer to obtain a ratio of 20 weight parts for 100 weight parts of the mixture of the urethane prepolymer and the curing agent. The specimens were made from this sheet.

Reference Example 21

Used for Comparative Example 5

A curable urethane composition (with an H/NCO equivalent ratio of 0.90) was prepared by mixing a urethane prepolymer (NCO: 5.80%), obtained by mixing 70 parts by weight of a urethane prepolymer (NCO: 4.41%), obtained by reacting tolylenediisocyanate (TDI) and polytetramethylene glycol (PTMG), and 30 parts by weight of a urethane prepolymer (NCO: 9.04%), obtained by reacting methylenebis(1,4-phenylene)diisocyanate (MDI) and polytetramethylene glycol (PTMG), and a curing agent mixture (Ethacure 300) of 3,5-dimethylthio-2,4-toluenediamine and 3,5-dimethylthio-2,6-toluenediamine. This curable urethane composition was poured into a mold which had been preheated at 115° C. After precuring at 115° C. for 3 hours, post-curing was performed at 115° C. for 14 hours to obtain a polyurethane sheet (with a thickness of 3.4 mm, and having at its center a semicircular groove of 1.5 mm radius). The specimens were made from this sheet.

Reference Example 22

Used for Inventive Example 17

A polyurethane sheet (with a thickness of 3.4 mm, and having at its center a semicircular groove of 1.5 mm radius) was obtained as in Reference Example 21 except that calcined kaolin clay (average particle size: 1.4 μm, specific surface area: 10.4 $m^2/g$) modified by 0.5% by weight of 3-aminopropyltriethoxysilane, which had been dried at 100° C. for 2 hours, was mixed beforehand with the prepolymer to obtain a ratio of 20 weight parts for 100 weight parts of the mixture of the urethane prepolymer and the curing agent. The specimens were made from this sheet.

The "JIS A hardness" and the flexural tests for the specimens produced in Reference Examples 1 to 22 were evaluated. The results obtained are shown in Table 1.

Figure 3:
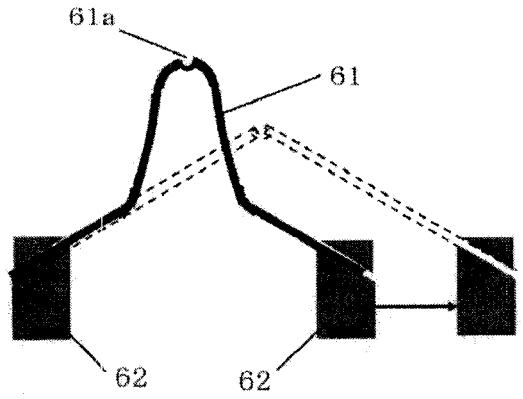
FIG. 3 is view illustrating the flexing test similar to De Mattia used in the present invention (publicly known).

The test apparatus shown in FIG. 3 was used in flexing tests similar to the De Mattia flexing test defined by JIS K 6260-2500 to test the crack development at a temperature of 20° C. and a relative humidity of 52% under the following conditions:

The size of a specimen 61 was: width=25 mm, length=185 mm (including 20 mm on each side for grips), thickness=3.4 mm; the distance between grips 62 was 150 mm; the specimen had a semicircular dimple 61*a* with a radius of 1.5 mm at their center. The back and forth movement of the grips took place with a speed of 360 strokes/minute over a distance of 65 mm between the greatest grip distance of 100 mm and the smallest grip distance of 35 mm. A notch with a 2 mm length in the width direction was provided at the center of the specimens. The grips 62, 62 on the left and right sides are provided so as to form an angle of 45°, respectively, in the back and forth directions. The specimens were repeatedly flexed under these conditions, and after prescribed stroke counts, the length of cracks was measured. The term stroke count used here represents a value which is the sum of the test time multiplied by the speed of the back and forth movement. The test was finished when the cracks, which had an initial notch length of about 2 mm, exceeded 15 mm. Approximate curves of the stroke count and the crack length were plotted, and the stroke counts at the crack length of 15 mm were read from the approximate curves. The length of the cracks that had grown (the measured value of the crack length of 15 mm−value of the initial notch length) was divided by the corresponding stroke count (De Mattia flexing test results) to obtain the fatigue crack growth rate (crack growth speed μm/stroke count).

TABLE 1

| Reference Example | Inventive, Comparative Example | -NCO Compound | Curing Agent | H/NCO Equivalent Ratio | Filler | Filler Amount Weight Parts | JIS-A Hardness | Crack Growth Rate (μm/stroke count) | Wear Depth (mm) |
|---|---|---|---|---|---|---|---|---|---|
| 1 | Compar. Ex. 1 | TDI | Ethacure 300 | 0.95 | — | 0 | 95.8 | 8.91 | 0.275 |
| 2 | Invent. Ex. 1 | TDI | Ethacure 300 | 0.95 | modified calcined kaolin clay | 1 | 95.9 | 1.90 | 0.219 |
| 3 | Invent. Ex. 2 | TDI | Ethacure 300 | 0.95 | modified calcined kaolin clay | 5 | 96.1 | 1.76 | 0.168 |
| 4 | Invent. Ex. 3 | TDI | Ethacure 300 | 0.95 | modified calcined kaolin clay | 12 | 97.1 | 1.34 | 0.159 |
| 5 | Invent. Ex. 4 | TDI | Ethacure 300 | 0.95 | modified calcined kaolin clay | 20 | 97.0 | 0.41 | 0.155 |
| 6 | Invent. Ex. 5 | TDI | Ethacure 300 | 0.95 | modified calcined kaolin clay | 30 | 97.4 | 0.34 | 0.138 |
| 7 | Invent. Ex. 6 | TDI | Ethacure 300 | 0.95 | modified calcined kaolin clay | 40 | 98.0 | 0.32 | 0.129 |
| 8 | Invent. Ex. 7 | TDI | Ethacure 100 | 1.00 | modified calcined kaolin clay | 20 | 97.1 | 0.35 | 0.090 |
| 9 | Invent. Ex. 8 | TDI | Ethacure 100/300 mixture | 1.00 | modified calcined kaolin clay | 20 | 97.3 | 0.29 | 0.232 |
| 10 | Invent. Ex. 9 | TDI | Ethacure 300 | 0.95 | fused silica | 20 | 96.2 | 1.95 | 0.125 |
| 11 | Invent. Ex. 10 | TDI | Ethacure 300 | 0.95 | zeolite | 20 | 96.5 | 1.96 | 0.138 |
| 12 | Compar. Ex. 2 | TDI | Ethacure 300 | 0.95 | mica | 20 | 96.9 | 0.86 | 1.496 |
| 13 | Compar. Ex. 3 | TDI | Ethacure 300 | 0.95 | — | 0 | 91.9 | 1.79 | 1.793 |
| 14 | Invent. Ex. 11 | TDI | Ethacure 300 | 0.95 | calcined kaolin clay | 10 | 93.9 | 0.12 | 1.830 |
| 15 | Invent. Ex. 12 | TDI | Ethacure 300 | 0.95 | modified calcined kaolin clay | 10 | 93.8 | 0.07 | 0.495 |
| 16 | Invent. Ex. 13 | TDI | Ethacure 300 | 0.95 | fused silica | 10 | 94.2 | 0.07 | 1.940 |
| 17 | Invent. Ex. 14 | TDI | Ethacure 300 | 0.95 | modified fused silica | 10 | 94.0 | 0.03 | 0.340 |
| 18 | Invent. Ex. 15 | TDI | Ethacure 300 | 0.95 | modified fused silica | 10 | 94.1 | 0.03 | 0.275 |
| 19 | Compar. Ex. 4 | MDI | 1,4-BD/Ethacure 300 mixture | 0.90 | — | 0 | 93.2 | 4.02 | 2.202 |
| 20 | Invent. Ex. 16 | MDI | 1,4-BD/Ethacure 300 mixture | 0.90 | modified calcined kaolin clay | 20 | 95.1 | 0.80 | 0.851 |
| 21 | Compar. Ex. 5 | TDI/MDI mixture | Ethacure 300 | 0.90 | — | 0 | 92.4 | 5.50 | 0.404 |

TABLE 1-continued

| Reference Example | Inventive, Comparative Example | -NCO Compound | Curing Agent | H/NCO Equivalent Ratio | Filler | Filler Amount Weight Parts | JIS-A Hardness | Crack Growth Rate (μm/stroke count) | Wear Depth (mm) |
|---|---|---|---|---|---|---|---|---|---|
| 22 | Invent. Ex. 17 | TDI/MDI mixture | Ethacure 300 | 0.90 | modified calcined kaolin clay | 20 | 94.6 | 0.83 | 0.116 |

Hereinafter, examples of manufacturing shoe press belts using the curable urethane composition used in Reference Examples 1 to 22 will be described.

Inventive Example 1

Step 1: A parting agent (KS-61, manufactured by Sin-Etsu Chemical Co., Ltd.) was coated on the polished surface of a mandrel having a diameter of 1,500 mm which can be rotated by a suitable driving means. Next, a polyurethane layer was formed by coating a polyurethane resin mixture (H/NCO equivalent ratio: 0.95), obtained by mixing the urethane prepolymer (TDI/PTMG prepolymer) and a curing agent mixture (Ethacure 300) of 3,5-dimethylthio-2,4-toluenediamine and 3,5-dimethylthio-2,6-toluenediamine used in Reference example 1, to a thickness of 1.4 mm onto the rotating mandrel by using a doctor bar. The polyurethane resin mixture was left on the rotating mandrel at room temperature (30° C.) for 40 minutes. Then, a shoe-side inner circumferential polyurethane layer was produced by heat-precuring the polyurethane resin mixture with a heating device attached to the mandrel at 100° C. for 30 minutes.

Step 2: A grid-like web (MD yarn density 1 yarn/cm, CMD yarn density: 4 yarns/cm) was prepared from CMD yarns comprising multifilament twisted yarns of 5,000 dtex made from polyethylene terephthalate fibers and MD yarns comprising multifilament yarns of 550 dtex; wherein the MD yarns are sandwiched by the CMD yarns and the crossings of the MD yarns and the CMD yarns are joined by a urethane resin adhesive. A plurality of grid-like webs was placed as one layer, without gaps therebetween, on the outer circumference of the shoe-side layer so that the CMD yarns extend along the axis direction of the mandrel. Then, a wound-yarn layer was formed by helically winding multifilament yarns of 6,700 dtex polyethylene terephthalate fibers around the outer circumference of the grid-like web at a pitch of 30 yarns/5 cm. Thereafter, an integral structure was formed by coating the polyurethane resin mixture as intermediate layer to a thickness of 1.6 mm sufficiently to close the gap between the grid-like web and the wound-yarn layer; thereby, a reinforcing fibrous base material polyurethane intermediate layer was formed.

Step 3: The curable urethane composition, used in Reference Example 2 was coated to a thickness of about 2.5 mm onto the wound-yarn layer by using a doctor blade and left to stand at room temperature for 40 minutes. Then, a wet paper web-side layer (outer circumferential polyurethane layer) was produced by post-curing by heating at 110° C. for 4 hours. Next, the surface of the wet paper web-side layer was polished until the overall thickness was 5.2 mm, and a plurality of concave grooves (width: 0.8 mm, depth: 0.8 mm, and pitch: 2.54 mm) was formed in the MD direction of the belt by using a rotating blade. In this manner a shoe press belt was produced.

Inventive Examples 2 to 17

The shoe press belts in Inventive Examples 2 to 17 were produced in the same manner as in Inventive Example 1 except that, instead of the curable urethane composition of Reference Example 2, the curable urethane compositions used in Reference Examples 3 to 11, Reference Examples 14 to 18, Reference Example 20 and Reference Example 22 were used for the outer polyurethane layer.

Comparative Examples 1 to 5

The shoe press belts in Comparative Examples 1 to 5 were produced in the same manner as in Inventive Example 1 except that, instead of the curable urethane composition of Reference Example 2, the curable urethane compositions used in Reference Examples 1, 12, 13, 19 and 21 were used for the outer polyurethane layer.

Figure 4:
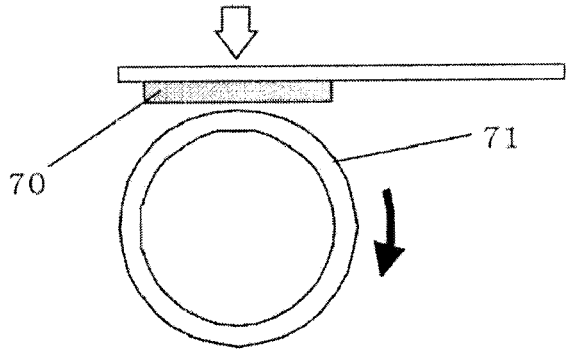
FIG. 4 is a view illustrating the wear test used in the present invention (publicly known).
Figure 5:
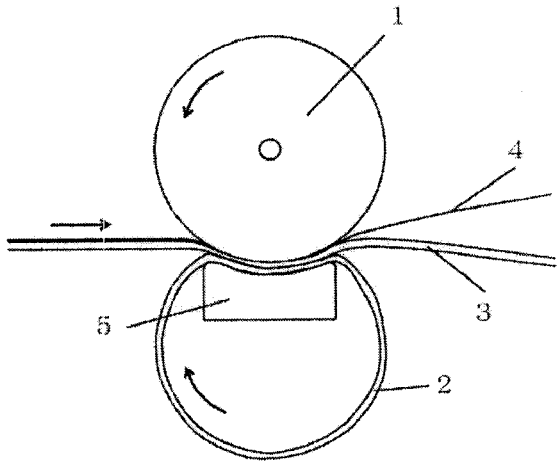
FIG. 5 is a cross-sectional view of a dewatering device for wet paper webs (publicly known).

Wear tests were performed with the shoe press belts produced in Inventive Examples 1 to 17 and Comparative Examples 1 to 5. In the wear tests, the test apparatus shown in FIG. 4 was used, a specimen 70 was attached to the lower part of a press board, and a rotating roll 71 equipped with a friction member on its outer circumference was rotated while being pressed against the lower surface of the specimen (the surface to be measured). The rotating roll applied a pressure of 6.6 kg/cm and was rotated at a rotational speed of 100 m/minute for 45 seconds. After the belt had been rotated, the reduction in the thickness of the belt sample (depth of wear) was measured.

The reduction of the thickness (depth of wear) of the belt specimens is shown in Table 1.

From Table 1 it can be seen that the specimens with polyurethane comprising calcined kaolin clay, fused silica or zeolite as urethane for papermaking process belts according to the present invention had, without reducing wear resistance, a better fatigue crack growth rate suppressing effect and flexural resistance than the specimens with the polyurethane of the Comparative Examples.

INDUSTRIAL APPLICABILITY

A polyurethane papermaking process belt according to the present invention has better wear resistance, crack resistance and fatigue crack resistance than existing belts and 2 to 20 times the operational life of existing commercially available process belts using TDI and MDI as isocyanate compounds.

| Reference Signs List | |
|---|---|
| 2a | Shoe press belt outer layer |
| 2b | Shoe press belt inner layer |
| 2c | Shoe press belt intermediate layer |
| 6 | Reinforcing fibrous base material |
| 21 | Shoe press belt outer layer |
| 22 | Shoe press belt inner layer |
| 24 | Concave groove |
| 25 | Convex part |

The invention claimed is:

1. A papermaking process belt comprising an integrated structure of a reinforcing fibrous base material and a polyurethane layer, the reinforcing fibrous base material being embedded in the polyurethane; wherein one part of the polyurethane or all of the polyurethane is formed by heat curing of a curable urethane composition comprising a urethane prepolymer having a terminal isocyanate group, which is obtained by a process comprising reacting an aromatic isocyanate compound and polyol, a curing agent having an active hydrogen group, and 0.3 to 30% by weight of an inorganic filler of which the main component is a silicon oxide component selected from calcined kaolin clay, fused silica and zeolite of an average particle size of 1 to 20 μm.

2. The papermaking process belt according to claim 1, wherein, in the inorganic filler, the particle surfaces of the calcined kaolin clay or the fused silica are treated with 0.2 to 3% by weight (as a percentage of the weight of the inorganic filler that is surface-treated by the organic silane coupling agent) of an organic silane coupling agent.

3. The papermaking process belt according to claim 1, wherein the "JIS A hardness" of the polyurethane outer layer side of the papermaking process belt that is in contact with the wet paper web is 91 to 100.

4. The papermaking process belt according to claim 1, wherein the inorganic filler has an average particle size of from 1 to 10 μm.

5. The papermaking process belt according to claim 1, wherein the inorganic filler is reacted in an amount of from 1.0 to 20% by weight.

6. The papermaking process belt according to claim 1, wherein the isocyanate is at least one selected from the group consisting of 2,4-tolylene-diisocyanate, 2,6-tolylene-diisocyanate, 1,5-napthalene-diisocyanate, p-phenylene-diisocyanate, 4,4'-methylenebis (phenylisocyanate) and metaxylene diisocyanate.

7. The papermaking process belt according to claim 1, wherein the polyol is a polyether polyol or a polyester polyol.

8. The papermaking process belt according to claim 1, wherein the polyol is a polyether polyol selected from the group consisting of polytetramethylene glycol, polyethylene glycol and polypropylene glycol.

9. The papermaking process belt according to claim 1, wherein the polyol is a polyester polyol selected from the group consisting of polycaprolactone ester, polycarbonate, polyethylene adipate, polybutylene adipate, polyhexane adipate.

10. The papermaking process belt according to claim 1, wherein the inorganic filler has a moisture content of less than 1.0% by weight.

11. The papermaking process belt according to claim 1, wherein a particle surface of the inorganic filler has been treated with an organic silane coupling agent.

12. A method for making a papermaking process belt comprising an integrated structure of a reinforcing fibrous base material and a polyurethane layer, the reinforcing fibrous base material being embedded in the polyurethane; wherein are comprised a process for obtaining a curable urethane composition by mixing a urethane prepolymer, a curing agent having an active hydrogen group and an inorganic filler, and a process for forming a polyurethane layer by heat-curing a curable urethane composition, wherein one part or all of the polyurethane is made from the curable urethane composition and a reinforcing fibrous base material is embedded therein, and wherein the inorganic filler comprises, as main component, a silicon oxide component selected from calcined kaolin clay, fused silica and zeolite of an average particle size of 1 to 20 μm, and wherein the inorganic filler is 0.3 to 30% by weight of the curable urethane composition, and the urethane prepolymer having a terminal isocyanate group is made by reacting an aromatic isocyanate compound and a polyol.

* * * * *